US007417539B2

(12) United States Patent
Mathews et al.

(10) Patent No.: US 7,417,539 B2
(45) Date of Patent: Aug. 26, 2008

(54) BABY MONITOR SYSTEM

(75) Inventors: Richard H. Mathews, Phoenixville, PA (US); Jeffrey Swan, West Chester, PA (US); Thomas Pollack, West Chester, PA (US)

(73) Assignee: Graco Children's Products Inc., Exton, PA (US)

( * ) Notice: Subject to any disclaimer, the term of this patent is extended or adjusted under 35 U.S.C. 154(b) by 214 days.

(21) Appl. No.: 11/126,391

(22) Filed: May 11, 2005

(65) Prior Publication Data

US 2006/0255936 A1 Nov. 16, 2006

(51) Int. Cl.
*G08B 1/08* (2006.01)

(52) U.S. Cl. ..... 340/539.15; 340/539.1; 340/539.11; 379/433.11; D14/137

(58) Field of Classification Search ..... 340/539.15, 340/539.1, 539.11; 379/433.11; D14/137
See application file for complete search history.

(56) References Cited

U.S. PATENT DOCUMENTS 5,848,152 A * 12/1998 Slipy et al. ..... 379/433.13
5,982,881 A * 11/1999 Mischenko ..... 379/433.11
D446,202 S 8/2001 Fitzgerald
D456,800 S 5/2002 Rade
7,098,785 B2 * 8/2006 Wong et al. ..... 340/539.15
7,197,345 B2 * 3/2007 Kim et al. ..... 455/575.3

OTHER PUBLICATIONS

VTech Onlin Store, "Changeable handset and base plates: three sets included" for Cordless Phone gz2456, 1 pp., VTech Communications, Inc. (2004).
eValueZone.com, VTech gz2434 2.4 GHz Analog Cordless Teen Phone with Changeable Faceplates, 2 pp. (product depicted is admitted prior art).
Procura.com, Nokia 91933NOK Faceplates, 4 pp. (2003).
Texas Instruments Online Information, "TI-84 Plus Silver Edition," 6 pp., Texas Instruments, Inc. (product depicted is admitted prior art).
Educalc.net, "hp 30s scientific calculator," 2 pp. (product depicted is admitted prior art).
The Palm Store USA Online Store, "Prime Choice m100 Series Face Plates," 2 pp., palmOne, INc. (product depocted is admitted prior art).
kiosk Business, Articles Archive index and "First Look" article, May/Jun. 2001, 6 pp. (2001).

* cited by examiner

*Primary Examiner*—Davetta W. Goins
(74) *Attorney, Agent, or Firm*—Lempia Braidwood LLC

(57) ABSTRACT

A baby monitor system includes a transmitter unit that has a first receiver to receive baby sounds, a transmitter to transmit a signal corresponding to the baby sounds, and a transmitter housing to house the first receiver and the transmitter. The transmitter housing includes a faceplate connector. The baby monitor system also includes a receiver unit having a second receiver to receive the signal transmitted by the transmitter unit. The baby monitor system further includes a plurality of transmitter faceplates that can be interchangeably connected to the faceplate connector of the transmitter housing.

24 Claims, 4 Drawing Sheets

BABY MONITOR SYSTEM

FIELD OF THE INVENTION

The invention relates to a baby monitor system. More specifically, the invention relates to a baby monitor system in which different faceplates can be interchangeably connected to a baby monitor transmitter unit or to a baby monitor receiver unit.

BACKGROUND OF THE INVENTION

Baby monitor systems exist for monitoring the status of a baby when a parent cannot see the baby. Baby monitor systems typically include a child unit that remains near the baby and a portable parent unit that a parent can carry. The child unit generally includes a radio transmitter, and the parent unit generally includes a radio receiver operating on the same frequency as the radio transmitter. The child unit has a microphone that picks up sounds from the baby, and the child unit converts the sounds to an electrical signal and transmits the electrical signal to the parent unit. The parent unit receives the electrical signal and sends it to a speaker, where it is converted into sound. Thus, if a parent has to leave a room in which the baby is resting, the baby monitor system allows the parent to listen to the baby while the parent takes care of business in other parts of the house.

Parents often take particular care to decorate the baby's nursery. Conventional baby monitors, however, can clash with the décor of the baby's nursery. For example, a blue-colored baby monitor unit may clash with a baby nursery painted pink. Conversely, a pink-colored baby monitor unit may clash with a baby nursery painted blue.

Thus, there is a need for a baby monitor system that would blend in with the other surroundings in a baby's nursery.

SUMMARY OF THE INVENTION

An aspect of the present invention relates to a baby monitor system that includes a transmitter unit that has a first receiver to receive baby sounds, a transmitter to transmit a signal corresponding to the baby sounds, and a transmitter housing to house the first receiver and the transmitter. The transmitter housing includes a faceplate connector. The baby monitor system also includes a receiver unit having a second receiver to receive the signal transmitted by the transmitter unit. The baby monitor system further includes a plurality of transmitter faceplates that can be interchangeably connected to the faceplate connector of the transmitter housing.

Another aspect of the present invention relates to a baby monitor system that includes a transmitter and a receiver provided in a vicinity of a baby. The baby monitor system also includes a housing that houses the transmitter and the receiver, the housing having a faceplate connector. The baby monitor system further includes a plurality of transmitter faceplates that can be interchangeably connected to the faceplate connector of the housing.

A further aspect of the invention relates to a baby monitor system that includes a transmitter unit that has a first receiver to receive baby sounds, a transmitter to transmit a signal corresponding to the baby sounds, and a transmitter housing to house the first receiver and the transmitter, the transmitter housing having a faceplate connector. The baby monitor system also includes a receiver unit having a second receiver to receive the signal from the transmitter unit. The baby monitor system further includes a plurality of faceplates that are interchangeably connectable to the faceplate connector of the transmitter housing, each of the faceplates having unique indicia to coordinate with décor in a vicinity of the transmitter unit.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION

Reference will now be made in detail to embodiments of the invention, examples of which are illustrated in the accompanying drawings. An effort has been made to use the same reference numbers throughout the drawings to refer to the same or like parts.

A baby monitor system according to a first embodiment of the invention includes a transmitter unit. The transmitter unit includes a receiver to receive baby sounds, a transmitter to transmit a signal corresponding to the baby sounds, a transmitter housing to house the receiver and the transmitter, and a faceplate connector. The baby monitor system also includes a receiver unit having a receiver to receive the signal transmitted by the transmitter unit. The baby monitor system further includes two or more transmitter faceplates that can be interchangeably connected to the faceplate connector of the transmitter housing. The transmitter unit can be located nearby a baby to monitor sounds made by the baby, as well as other sounds in the baby's room. The receiver unit can be taken with a caregiver who has left the room in which the baby is located, so that the caregiver can monitor the baby even when the caregiver is outside the baby's room. The interchangeable faceplates, such as faceplate 120, can be customized to match or coordinate the transmitter unit to the nursery theme or color scheme of the baby's room.

Figure 2:
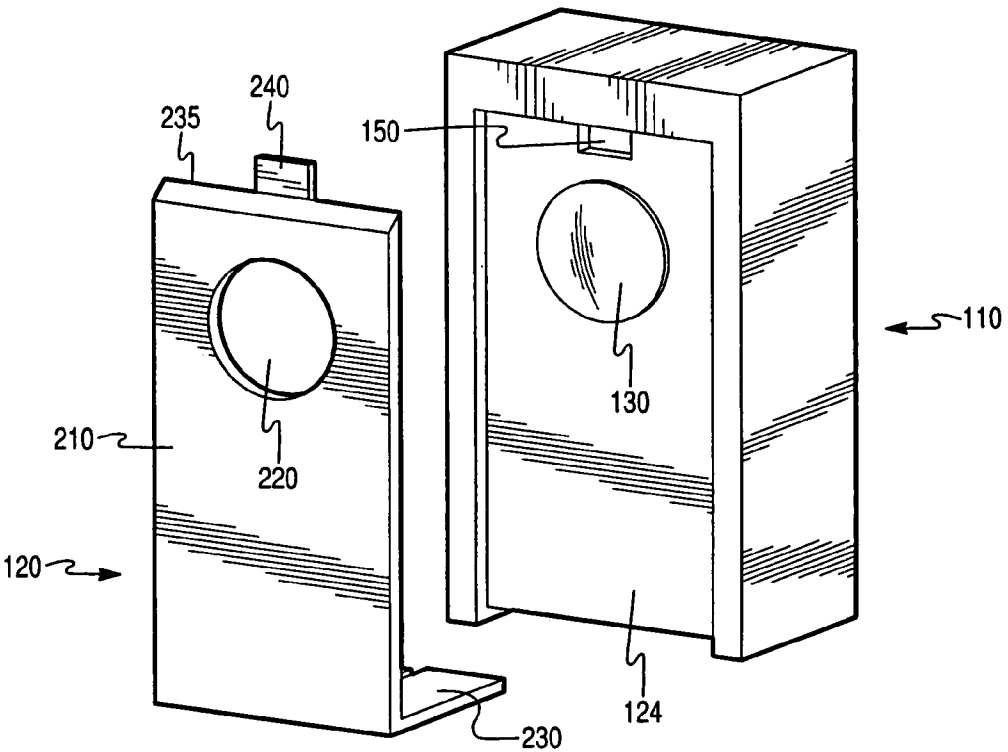
FIG. 2 is an exploded perspective front view of the baby monitor housing and the removable faceplate.
Figure 1:
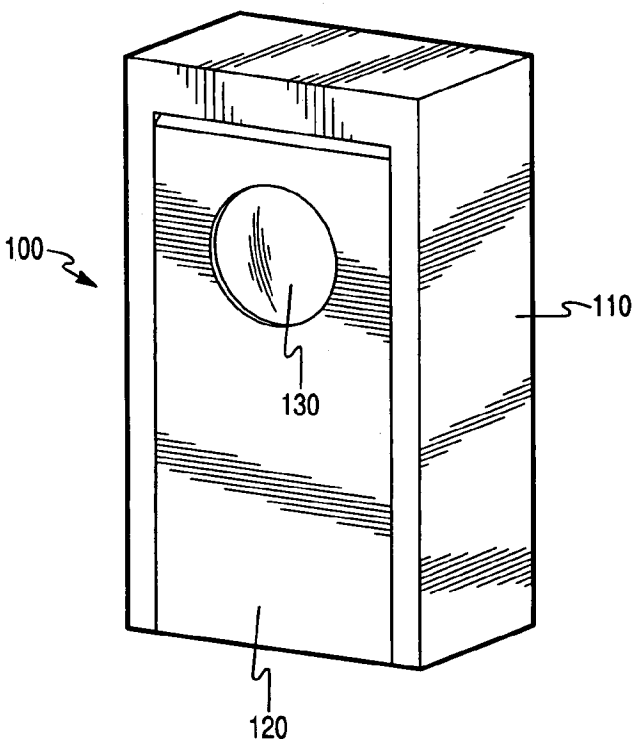
FIG. 1 is a front perspective view of a baby monitor housing and removable faceplate according to an embodiment of the invention.

FIGS. 1 and 2 show a transmitter unit 100 of a baby monitor system according to a first embodiment of the invention. The transmitter unit 100 includes a transmitter housing 110 and a faceplate 120. The transmitter housing 110 preferably is of a neutral color, such as white or off-white or beige, but other colors may be envisioned while remaining within the spirit and scope of the invention.

The faceplate 120 can come in a variety of different colors, such as blue, pink, white, green, etc. In the first embodiment, the baby monitor system includes at least two different-colored faceplates, such as a pink-colored faceplate and a blue-colored faceplate, and a caregiver can select a faceplate of a desired color to connect to the transmitter housing 110. For example, if the transmitter housing 110 is to be placed in a baby's room that is painted pink and/or that has a pink décor, the caregiver can select the pink-colored faceplate 120 to connect to the transmitter housing 110, in order to have the baby monitor system match the décor of the baby's room. Alternatively, if the transmitter housing 110 is to be placed in a baby's room that is painted blue and/or that has a blue décor, the caregiver can select the blue-colored faceplate 120 to connect to the transmitter housing 110.

As shown best in FIG. 2, the transmitter housing 110 has a rectangular shape; other shapes (e.g., curved) are contemplated. The transmitter housing 110 has a recessed area 124 on its front surface. The recessed area 124 is sized to accommodate the faceplate 120. The transmitter housing 110 houses a transmitter (not shown) and a receiver (not shown). The receiver can be a microphone for picking up sounds from the baby, and the transmitter can be an antenna for transmitting signals representing those sounds to a different location.

The receiver can be disposed directly behind a raised circular region 130 on a front surface of the transmitter housing 110, and the raised circular region 130 can be surrounded by the recessed area 124 of the transmitter housing 110. The raised circular region 130 can be made of a cloth-like material, similar to the material used for conventional speakers and microphones. The remaining portions of the transmitter housing 110 can be made of a hard plastic material, or alternatively they can be constructed partially or entirely of metal. The transmitter housing 110 also houses circuitry for processing the sound signals prior to transmission of those sound signals over-the-air to a different location.

The faceplate 120 is sized to snugly fit into the recessed area of the transmitter housing 110, as seen best in FIG. 1. As seen in FIG. 2, the faceplate 120 has a first, upright panel 210 with a circular opening 220, which fits directly over the raised circular region 130 of the transmitter housing 110. That way, sounds can be picked up by the receiver located within the transmitter housing 110 without those sounds being attenuated by the structure of the faceplate 120. The faceplate 120 also has a second, lateral panel 230 that is sized to snugly fit in a recessed area provided on a bottom surface 315 of the transmitter housing 110. The lateral panel 230 of the faceplate 120 can be angled 90 degrees with respect to the upright panel 210, so that the faceplate 120 can form an "L" shape. The faceplate 120 can be constructed out of plastic, but alternatively it may be constructed either partially or entirely of metal.

The upright panel 210 can include an upper edge 235, and a tab 240 can extend from the upper edge 235. The tab 240 can be sized to fit within a tab-receiving slot 150 of the transmitter housing 110. The tab 240 can be located at a middle of the upper edge 235 of the faceplate 120, with respect to a widthwise direction of the faceplate 120.

Figure 3:
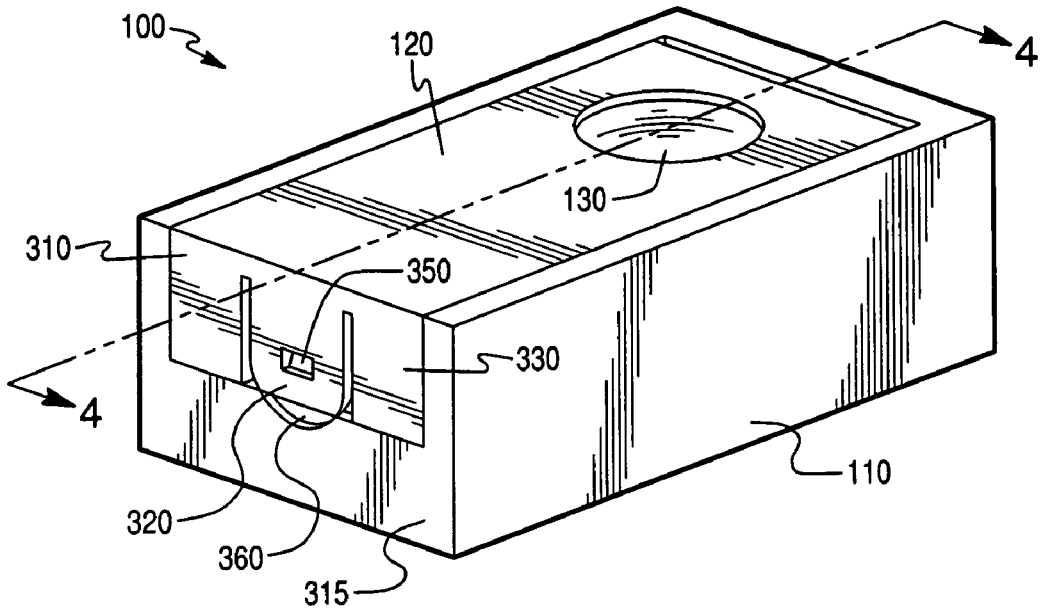
FIG. 3 is a bottom perspective view of the baby monitor housing and the removable faceplate.

Attachment of the faceplate 120 to the transmitter housing 110 will be explained with reference to FIGS. 3-5. FIG. 3 is a perspective view of a baby monitor system in which the faceplate 120 is fit onto the transmitter housing 110 according to the first embodiment of the invention. The lateral panel 230 of the faceplate 120 can be seen in FIG. 3. The lateral panel 230 can include a left-side region 310, a middle region 320, and a right-side region 330. The middle region 320 can operate as a latch plate and can be flexed to allow the middle region 320 to be fitted onto and removed from an outward-extending latch 350 formed on the bottom surface 315 of the transmitter housing 110. In more detail, when a caregiver desires to fit the faceplate 120 onto the transmitter housing 110, the caregiver can insert the tab 240 of the faceplate 120 into the tab-receiving slot 150 of the transmitter housing 110 and then lower the remaining portion of the faceplate 120 into the recessed area 124 of the transmitter housing 110. The latch plate 320 can include an opening 335 that receives outward-extending latch 350 on the bottom surface of the transmitter housing 110. By way of engagement of the tab 240 and the tab-receiving slot 150, and engagement of the latch plate 320 and the latch 350, the faceplate 120 is held firmly in place on the transmitter housing 110 at two separate places (a top part and a bottom part of the faceplate 120). The outward-extending latch 350 has a ramped top surface (not labeled, but see the visible surface of the latch 350 shown in FIG. 3), and the latch plate 320 has a corresponding ramped bottom surface 338 so that, as the faceplate 120 is being fit to the transmitter housing 110, the latch plate 320 flexes and the ramped surface 338 of the latch plate 320 can slide along and past the ramped surface of the latch 350, at which time the latch plate 320 flexes to its normal position and the latch 350 is received in the opening 335.

In this embodiment, the recessed area 124, the tab-receiving slot 150, and the latch 350 can serve as a faceplate connector of the transmitter housing 110 to which faceplates can be interchangeably connected. In other embodiments, the transmitter housing may include only one or a sub-combination of a recessed area, a tab-receiving slot, and a latch to serve as the faceplate connector. In addition, other faceplate connectors are envisioned.

Figure 4:
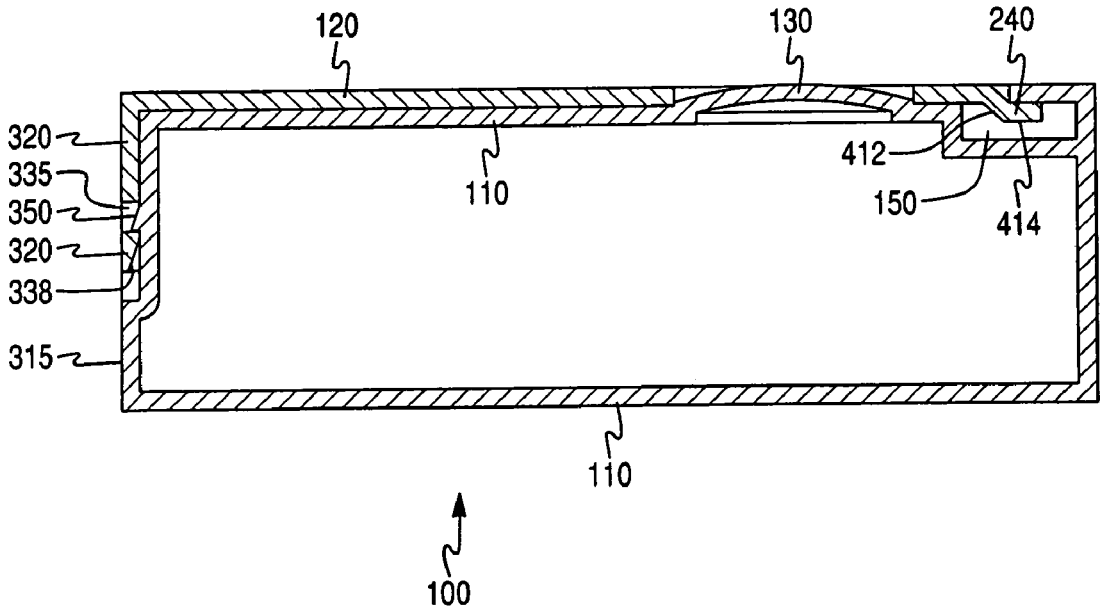
FIG. 4 is a cross section side view of the baby monitor housing and the removable faceplate, taken along line 4-4 in FIG. 3.
Figure 5:
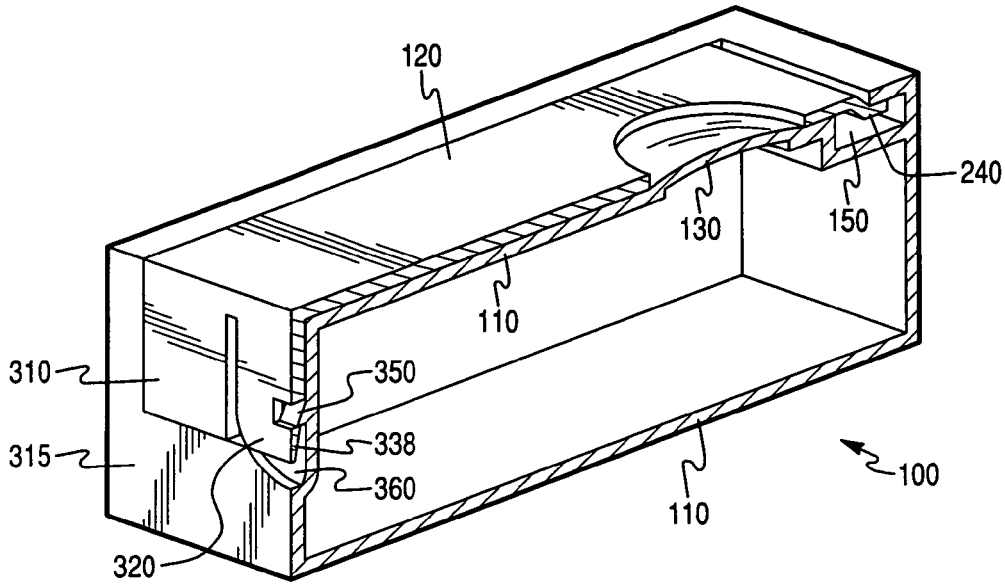
FIG. 5 is a cross section side perspective view of the baby monitor housing and the removable faceplate.

As seen in FIGS. 3-5, the bottom surface 315 of the transmitter housing 110 also includes an arcuate-shaped recessed region 360. The arcuate-shaped recessed region 360 allows a caregiver to easily remove the faceplate 120 from the transmitter housing 110 by placing a finger, a coin or some other firm, thin object in the arcuate-shaped recessed region 360, in order to flex the latch plate 320 away from the transmitter housing 110, and thereby disengage the latch plate 320 from the latch 350 of the transmitter housing 110. The caregiver then need only lift the faceplate 120 upward away from the transmitter housing 110 to disengage the tab 240 of the faceplate 120 from the tab-receiving slot 150 of the transmitter housing 110.

As shown best in FIG. 4, which shows a cross section of the faceplate 120 connected to the transmitter housing 110, the tab-receiving slot 150 is sized to be slightly deeper (e.g., 0.1 to 0.5 cm deeper) than the tab 240, so that the tab 240 can be readily inserted into and removed from the tab-receiving slot 150. The tab 240 is provided at the upper edge 235 of the faceplate 120 and has a first, angled section 412 and a second, straight section 414 for allowing the tab 240 to be readily fit into and removed from the tab-receiving slot 150. The angled section 412 can be angled about 45 degrees with respect to the upright panel 210 of the faceplate 120, and the straight section 414 can angled about 45 degrees with respect to the angled section 412 (and thus can be parallel with the upright panel 210).

Figure 6:
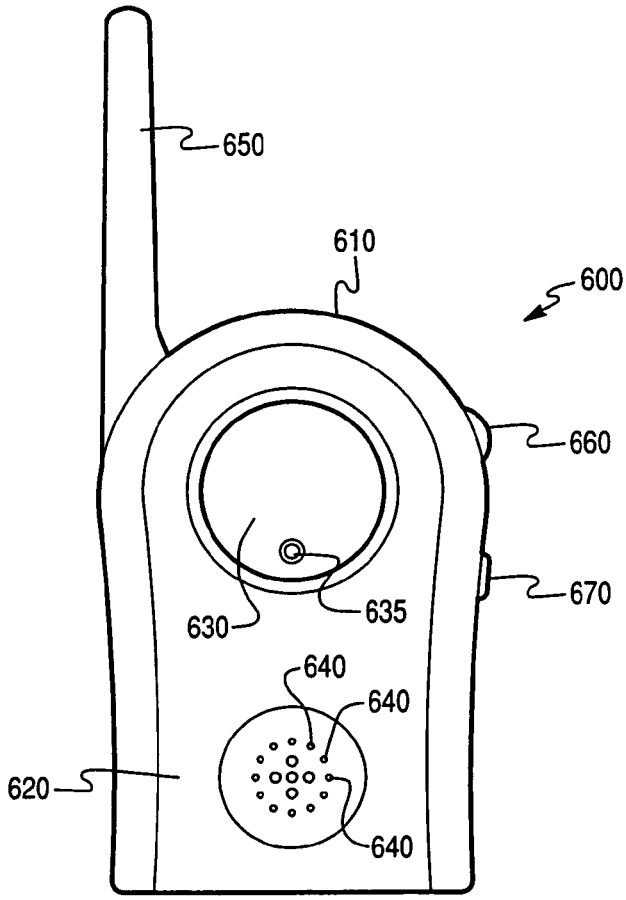
FIG. 6 is a front view of a baby monitor housing and a removable faceplate according to another embodiment of the invention.

FIG. 6 shows a baby monitor system 600 according to a second embodiment of the invention. In the second embodiment, a transmitter housing 610 and a faceplate 620 that fits onto the transmitter housing 610 both have a curved top surface. The transmitter housing 610 includes a circular region 630 that includes an indicator 635 for indicating a Power On/Power Off state. The transmitter housing 610 also includes a receiver (not shown) provided within a lower region of the transmitter unit 600, and a bottom portion of the faceplate 620 can include receiver openings 640 that provide a direct path for sound signals to be received and picked up by the receiver. Also shown in FIG. 6 is an antenna 650 for outputting sound signals over-the-air to a remote receiver (not shown), an On/Off button 660 provided on a side surface of the transmitter unit 600, and a volume control 670 provided on the side surface of the transmitter unit 600.

Similar to the first embodiment, the faceplate 620 fits snugly onto the transmitter housing 610. This snug fit is accomplished by engagement of a tab (not shown) provided on an upper edge of an upright panel of the faceplate 620 and a tab-receiving slot (not shown) in the transmitter housing 610, and engagement of an outward extending latch part on the bottom surface of the transmitter housing 610 and a latch plate on a lateral panel of the faceplate 620. Many of these components cannot be seen in FIG. 6; however, the discussion of the first embodiment explains these components and method of attachment in detail.

In an alternative implementation of the second embodiment, the circular region 630 of the transmitter unit 600 can include a temperature display (not shown) to provide a user with a visual indication of the current temperature within the room in which the transmitter housing 610 is located. In this alternative implementation, the transmitter housing 610 can include a temperature detection unit (not shown) provided either within the transmitter housing 610, or coupled to an exterior of the transmitter housing 610.

In a third embodiment of the invention, the transmitter unit of the baby monitor system has two or more faceplates that can be interchangeably connected to the transmitter housing like the first and second embodiments. In the third embodiment, each of the faceplates has a unique indicia to coordinate with décor in the vicinity of the transmitter unit. That unique indicia may correspond to one or more of the following: a) color, b) pattern, c) texture, d) embossing, and e) decals. The different colors for all or part of the faceplates may be due to colored plastic, applied color (markers, pens), and/or applied paint. The different patterns for all or part of the faceplates may be due to colored plastic, applied color (markers, pens), applied paint, and/or raised or depressed surface detailing. The different textures for all or part of the faceplates may include, for example, cotton texture, nylon texture, and/or denim texture. The different embossing on all or part of the faceplates may be due to raised or depressed surfaces, such as ribs and/or recesses. The different decals for all or part of the faceplates may be removable decals, such as stickers, or permanent decals, such as glued-on decals. The colors, patterns, textures, embossing, and/or decals may correspond to the nursery theme. For example, the indicia may correspond to animal shapes, sports shapes, or any other child-themed shape.

Figure 7A:
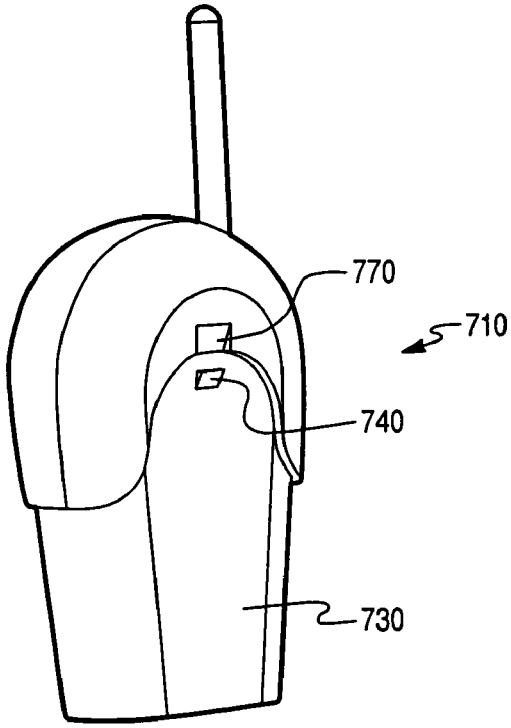
FIGS. 7A, 7B and 7C respectively show a front perspective view of a baby monitor housing, a front view of a removable faceplate, and a rear view of the removable faceplate according to another embodiment of the invention.
Figure 7B:
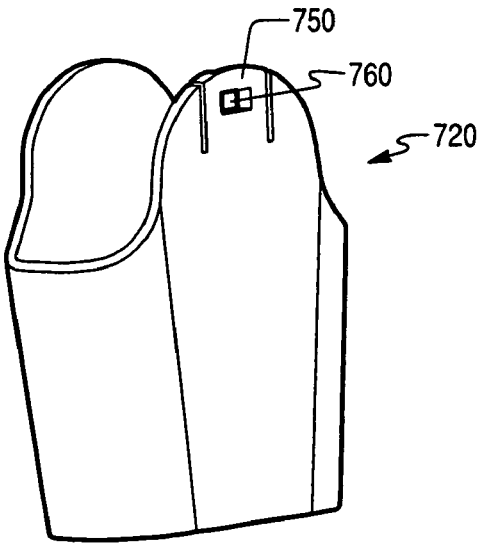
Figure 7C:
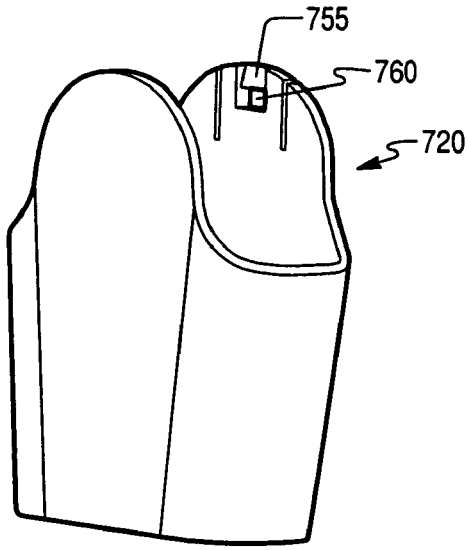

FIGS. 7A, 7B, and 7C show a baby monitor system according to a fourth embodiment of the invention. The baby monitor system includes a transmitter housing 710 and a faceplate 720. The faceplate 720 can be formed as a sleeve to fit around the transmitter housing 710. In this regard, the transmitter housing 710 includes a recessed area 730 that is sized to accommodate the faceplate 720. The transmitter housing 710 includes a latch 740, and the faceplate 720 includes a latch plate 750. As the faceplate 720 is being fit to the transmitter housing 710 (such as by lowering the transmitter housing 710 into the faceplate 720), the latch plate 750 flexes outward and a ramped surface 755 of the latch plate 750 can slide along and past a ramped surface of the latch 740, in a similar manner as described above with respect to the first embodiment. When engaged, the latch 740 sits within an opening 760 of the faceplate 720. Also, a ramped recessed region 770 is provided above the latch 740 on the transmitter housing 710 to allow a user to easily remove the faceplate 720 from engagement with the transmitter housing 710 by flexing the latch plate 750 away from the latch 740.

A construction similar to any of the above-described transmitter units can be utilized for a portable receiver unit used by a caregiver when the caregiver is located in a different room than where the baby is located. The receiver unit may include a receiver housing similar to any of the above-described transmitter housings. A faceplate for interchangeable connection to the remote receiver can be similar to any of the above-described faceplates for the transmitter units, but the faceplate of the remote receiver can include a circular opening that fits over a speaker opening of the remote receiver. The mechanisms for connecting the faceplate of the remote receiver to the remote receiver housing can be the same as any of the above-described mechanisms that interchangeably connect faceplates to the faceplate connector of the transmitter housing.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. For example, other methods of attachment of a faceplate to a transmitter housing or a remote receiver housing may be contemplated. The scope and spirit of the invention are indicated by the following claims.

What is claimed is:

1. A baby monitor system comprising:

a transmitter unit including a first receiver to receive baby sounds, a transmitter to transmit a signal corresponding to the baby sounds, and a transmitter housing to house the first receiver and the transmitter, the transmitter housing having an exterior surface and a faceplate connector extending outward from a recessed region in the exterior surface;

a receiver unit having a second receiver to receive the signal transmitted by the transmitter unit; and a plurality of transmitter faceplates each being independently selectable for removable attachment to the faceplate connector of the transmitter housing;

wherein each transmitter faceplate includes a plate to be received by the recessed region and engaged by the faceplate connector such that the recessed region, the faceplate connector, and the plate are exposed along the exterior surface of the transmitter housing to facilitate disengagement of the plate from the faceplate connector.

2. The baby monitor system according to claim 1, wherein the each transmitter faceplate has a color, and the color of each of the transmitter faceplates differs from the color of the other transmitter faceplates.

3. The baby monitor system according to claim 1, wherein each transmitter faceplate has a texture, and the texture of each of the transmitter faceplates differs from the texture of the other transmitter faceplates.

4. The baby monitor system according to claim 1, wherein each transmitter faceplate has a surface indicia, and the surface indicia of each of the transmitter faceplates differs from the surface indicia of the other transmitter faceplates.

5. The baby monitor system according to claim 1, wherein the receiver unit includes a receiver housing to house the second receiver, the receiver housing having a faceplate connector, and wherein the baby monitor system further comprises a plurality of receiver faceplates each being independently selectable for removable attachment to the faceplate connector of the receiver housing.

6. The baby monitor system according to claim 5, wherein each receiver faceplate has a color, and the color of each of the receiver faceplates differs from the color of the other receiver faceplates.

7. The baby monitor system according to claim 5, wherein each receiver faceplate has a texture, and the texture of each of the receiver faceplates differs from the texture of the other receiver faceplates.

8. The baby monitor system according to claim 5, wherein each receiver faceplate has a surface indicia, and the surface indicia of each of the receiver faceplates differs from the surface indicia of the other receiver faceplates.

9. The baby monitor system according to claim 1, wherein the exterior surface is on a bottom side of the transmitter housing such that the faceplate connector extends outward from the bottom side of the transmitter housing.

10. The baby monitor system according to claim 9, wherein the exterior surface is on a rear side of the transmitter housing such that the faceplate connector extends outward from the rear side of the transmitter housing.

11. The baby monitor system according to claim 1, wherein each of the faceplates includes an attachment tab to further engage the transmitter housing.

12. The baby monitor system according to claim 11, wherein the faceplate connector of the transmitter housing comprises a tab-receiving slot, and the attachment tab fits within the tab-receiving slot.

13. The baby monitor system of claim 1, wherein the first receiver is a microphone, and the transmitter unit further includes a converter to convert the baby sounds to the signal for transmission to the receiver unit.

14. The baby monitor system of claim 1, wherein the receiver unit further includes a speaker.

15. A baby monitor system comprising:

a transmitter and a receiver provided in a vicinity of a baby;

a housing that houses the transmitter and the receiver, the housing having an exterior surface and a faceplate connector extending outward from a recessed region in the exterior surface; and a plurality of faceplates each being independently selectable for removable attachment to the faceplate connector of the housing;

wherein each faceplate includes a plate to be received by the recessed region and engaged by the faceplate connector such that the recessed region, the faceplate connector, and the plate are exposed along the exterior surface of the housing to facilitate disengagement of the plate from the faceplate connector.

16. The baby monitor system according to claim 15, wherein each faceplate has a different color, and the color of each of the faceplates differs from the color of the other faceplates.

17. The baby monitor system according to claim 15, wherein each faceplate has a different texture, and the texture of each of the faceplates differs from the texture of the other faceplates.

18. The baby monitor system according to claim 15, wherein each faceplate has surface indicia, and the surface indicia of each of the faceplates differs from surface indicia of the other faceplates.

19. A baby monitor system according to claim 1, wherein each of the transmitter faceplates has unique indicia to coordinate with decor in a vicinity of the transmitter unit.

20. The baby monitor system according to claim 19, wherein the unique indicia includes at least one of a color, a pattern, a texture, an embossing, and a decal.

21. The baby monitor system according to claim 1, wherein the transmitter housing has a bottom with the recessed region, and wherein the panel of each transmitter faceplate is a lateral panel configured to be received in the recessed region on the bottom of the housing.

22. The baby monitor system according to claim 1, wherein the transmitter unit has a recessed area around the transmitter housing, and wherein each of the plurality of transmitter faceplates is a sleeve sized to fit over the recessed area.

23. The baby monitor system according to claim 15, wherein the housing has a bottom with the recessed region, and the panel of each faceplate is a lateral panel configured to be received in the recessed region on the bottom of the housing.

24. A baby monitor system comprising:

a transmitter unit including housing, a microphone in the housing to receive baby sounds, and a transmitter in the housing to transmit a signal corresponding to the baby sounds, the housing having an exterior surface and a faceplate connector extending outward from a recessed region in the exterior surface;

a receiver unit having a receiver to receive the signal transmitted by the transmitter unit; and an array of different faceplates each configured to removably attach to the transmitter housing and each being independently selectable by a user for attachment to the transmitter housing to alter a visible characteristic of the transmitter unit;

wherein each faceplate includes a plate to be received by the recessed region and engaged by the faceplate connector such that the recessed region, the faceplate connector, and the plate are exposed along the exterior surface of the transmitter housing to facilitate disengagement of the plate from the faceplate connector.

* * * * *

UNITED STATES PATENT AND TRADEMARK OFFICE

CERTIFICATE OF CORRECTION

PATENT NO. : 7,417,539 B2
APPLICATION NO. : 11/126391
DATED : August 26, 2008
INVENTOR(S) : Richard H. Mathews It is certified that error appears in the above-identified patent and that said Letters Patent is hereby corrected as shown below:

Column 6
claim 2, line 52, please delete "the"

Signed and Sealed this

Twenty-eighth Day of October, 2008

JON W. DUDAS
*Director of the United States Patent and Trademark Office*